US008557058B2

(12) United States Patent
Arita et al.

(10) Patent No.: US 8,557,058 B2
(45) Date of Patent: Oct. 15, 2013

(54) HIGH-STRENGTH NON-ORIENTED ELECTRICAL STEEL SHEET

(75) Inventors: Yoshihiro Arita, Tokyo (JP); Hidekuni Murakami, Tokyo (JP); Yutaka Matsumoto, Tokyo (JP); Saori Haranaka, Fukuoka (JP); Takeshi Kubota, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 462 days.

(21) Appl. No.: 12/309,622

(22) PCT Filed: Jun. 15, 2007

(86) PCT No.: PCT/JP2007/062551

§ 371 (c)(1),
(2), (4) Date: Jan. 22, 2009

(87) PCT Pub. No.: WO2008/013015

PCT Pub. Date: Jan. 31, 2008

(65) Prior Publication Data

US 2009/0301609 A1 Dec. 10, 2009

(30) Foreign Application Priority Data

Jul. 26, 2006 (JP) ..... 2006-203396

(51) Int. Cl.
*H01F 3/00* (2006.01)
*H01F 1/04* (2006.01)
*C22C 38/00* (2006.01)

(52) U.S. Cl.
USPC ..... 148/307; 148/111; 148/112; 148/310; 148/320

(58) Field of Classification Search
USPC ..... 148/111, 112, 307, 310, 320
See application file for complete search history.

(56) References Cited

U.S. PATENT DOCUMENTS

| | | | | |
|---|---|---|---|---|
| 5,084,112 | A * | 1/1992 | Tachino et al. | 148/111 |
| 2006/0185767 | A1 * | 8/2006 | Arita et al. | 148/111 |

FOREIGN PATENT DOCUMENTS

| | | | |
|---|---|---|---|
| CN | 1256321 | | 6/2000 |
| JP | 62-256917 | | 11/1987 |
| JP | 02-008346 | | 1/1990 |
| JP | 4-72904 | | 11/1992 |
| JP | 06-330255 | | 11/1994 |
| JP | 10-018005 | | 1/1998 |
| JP | 2000-129356 | | 5/2000 |
| JP | 2003-183734 | | 7/2003 |
| JP | 2003-342698 | | 12/2003 |
| JP | 2006-070348 | | 3/2006 |
| JP | 2006-70348 | | 3/2006 |
| JP | 2006070348 | A * | 3/2006 |
| JP | 2006-169611 | | 6/2006 |
| JP | 2007-16278 | | 1/2007 |
| JP | 2007-31755 | | 2/2007 |
| JP | 2007-39721 | | 2/2007 |
| JP | 2007-162096 | | 6/2007 |
| RU | 2018542 | | 8/1994 |
| RU | 2216600 | | 5/2003 |
| RU | 2004136280 | | 8/2005 |
| WO | 00/40765 | | 7/2000 |
| WO | 03/095684 | | 11/2003 |

OTHER PUBLICATIONS

International Search Report dated Oct. 9, 2007 issued in corresponding PCT Application No. PCT/JP2007/062551.
Official Decision of Grant in corresponding Russian Application No. 2009106654/02 (008893).
Certificate of Invention issued in corresponding Chinese patent application.
Japanese Office Action, dated Aug. 28, 2012, issued in the corresponding Japanese application.

* cited by examiner

*Primary Examiner* — Keith Walker
*Assistant Examiner* — Alexander Polyansky
(74) *Attorney, Agent, or Firm* — Kenyon & Kenyon LLP

(57) ABSTRACT

The invention provides a non-oriented electrical steel sheet excellent in yield strength for use as an iron core material for high rpm motors that does not sacrifice yield or productivity in motor core punching or steel sheet production, which non-oriented electrical steel sheet is given a chemical composition of, in mass %, C: 0.01 to 0.05%, Si: 2.0 to 4.0%, Mn: 0.05 to 0.5%, Al: 3.0% or less and Nb: 0.01 to 0.05%, and optionally Ni at a preferable content of more than 0.5% and less than 3.0%, the balance being Fe and unavoidable impurities, Mn and C contents expressed in mass % are made to satisfy $Mn \leq 0.6-10 \times C$, recrystallized portion area fraction is made 50% or greater, yield strength in tensile testing is made 650 MPa or greater, and average-grain diameter viewed in steel sheet cross-section is made 40 μm or less, and electrical steel sheet production is conducted using a hot-rolled sheet whose transition temperature in impact testing is 70° C. or less.

5 Claims, No Drawings

HIGH-STRENGTH NON-ORIENTED ELECTRICAL STEEL SHEET

FIELD OF THE INVENTION

This invention relates to a high-strength non-oriented electrical steel sheet for use as an iron core material in the motors of electric vehicles and hybrid vehicles and motors of electrical equipment.

DESCRIPTION OF THE RELATED ART

The need felt for energy-efficient electrical equipment has increased globally in recent years. As a result, demand for higher performance characteristics has emerged with regard to the non-oriented electrical steel sheet used as an iron core material in rotating machines.

Particularly noteworthy is the recent increase in the need for compact, high-output motors in such fields as electric and hybrid vehicles. In response to this need, motors are being designed that boost motor torque by increasing motor rpm.

Conventional high rpm motors are typified by the motors used in machine tools and vacuum cleaners. The aforesaid vehicle motors are bulkier than these conventional motors and have a so-called DC brushless motor structure that has magnets embedded near the rotor periphery. The width of the steel sheet of the bridges (between the rotor outermost periphery and the magnets) at the rotor periphery is therefore very narrow, as narrow as 1 to 2 mm at some locations. This has created a need for a non-oriented electrical steel sheet having high strength.

Steel strength is generally increased by addition of alloying elements. In a non-oriented electrical steel sheet, the Si, Al and other elements added to lower core loss enhance strength as an auxiliary effect. It is also known that high strength can be obtained by reducing the grain diameter of the steel.

These techniques are used, for example, in Japanese Patent Publication (A) No. S62-256917, which teach a method for attaining high steel strength by incorporating Mn and Ni in addition to Si so as to produce solid solution strengthening. This method distorts the iron lattice by solid-solving substitutional elements of different atomic size from iron in the matrix, thereby increasing the deformation resistance of the steel. Although the method increases strength, it simultaneously reduces toughness, so that it degrades punchability as well as yield and productivity.

Japanese Patent Publication (A) No. H06-330255 and Japanese Patent Publication (A) No. H10-18005 teach methods for attaining high steel strength by dispersing Nb, Zr, Ti and V carbonitrides into the steel to inhibit grain growth. However, the carbonitrides dispersed by these methods may themselves act as crack and fracture starting points. So even though they may refine grain diameter, they decrease, rather than increase, toughness and thus pose problems with regard to cracking of the punched motor core, cracking and breakage during steel sheet production, and a marked decline in yield and productivity.

SUMMARY OF THE INVENTION

The present invention provides, as an iron core material for high rpm motors, a non-oriented electrical steel sheet excellent in strength that does not sacrifice yield or productivity in motor core punching or steel sheet production.

The essence of the present invention realizing such capability lies in the non-oriented electrical steel sheet described in the following.

(1) A non-oriented electrical steel sheet comprising, in mass %, C: 0.01 to 0.05%, Si: 2.0 to 4.0%, Mn: 0.05 to 0.5%, Al: 3.0% or less, Nb: 0.01 to 0.05%, and a balance of Fe and unavoidable impurities, wherein Mn and C contents expressed in mass % satisfy $Mn \leq 0.6-10 \times C$, recrystallized portion area fraction of the steel sheet is 50% or greater, yield strength in tensile testing is 650 MPa or greater, breaking elongation is 10% or greater, and core loss W10/400 is 70 W/kg or less.

(2) A non-oriented electrical steel sheet according to (1), further comprising, in mass %, more than 0.5% and less than 3.0%.

(3) A non-oriented electrical steel sheet according to (2), wherein average grain diameter viewed in steel sheet cross-section is 40 μm or less.

(4) A non-oriented electrical steel sheet according to (2), which is produced from a hot-rolled sheet whose transition temperature in impact testing is 70° C. or less by subsequent steps of annealing, pickling, cold rolling and finish-annealing the hot-rolled sheet.

(5) A non-oriented electrical steel sheet according to (2), which is produced from a hot-rolled sheet whose transition temperature in impact testing is 70° C. or less by subsequent steps, from which annealing is omitted, of pickling, cold rolling and finish-annealing the hot-rolled sheet.

The present invention set out in the foregoing can provide at low cost a non-oriented electrical steel sheet excellent in strength that does not sacrifice yield or productivity during motor core or steel sheet production.

DETAILED DESCRIPTION OF THE INVENTION

The inventors conducted research regarding methods for utilizing addition of elements that strengthen steel not only to upgrade magnetic properties and strength but also to improve yield and productivity during motor core and steel sheet production.

Productivity improvement as termed here means prevention of cracking and fracture occurring during motor core punching and steel sheet production. High-strength steel sheets are brittle to begin with, so that cracks form at the steel sheet edges during motor core punching and cracking or breakage occurs during steel sheet production processes such as pickling and cold rolling, thereby markedly degrading yield and productivity.

The inventors therefore carried out in-depth research with regard to the toughness of post-finish-rolled electrical steel sheet (hereinafter sometimes called "product sheet") and hot-rolled sheet. They discovered that yield and productivity in the steel sheet production process and motor core punching process are markedly improved by defining, inter alia, Mn and C content, product sheet breaking elongation, and hot-rolled sheet impact property. They accomplished the present invention based on this knowledge.

The so-achieved invention is progressively explained in the following.

The reason for defining the composition of the non-oriented electrical steel sheet of the present invention will be explained first. Unless otherwise indicated, the symbol % used with respect to element content indicates mass %.

C is required for forming carbides. Fine carbides increase the number of nucleation sites during recrystallization and also contribute to grain refinement by inhibiting recrystallization grain growth, thereby working to establish high steel strength. C content of 0.01% or greater is required for thoroughly realizing these effects. When C content exceeds 0.05%, the effects of C addition saturate and core loss property deteriorates. The upper limit of C content is therefore defined as 0.05%.

Si increases steel specific resistance and is also effective for solid solution strengthening. The upper limit of addition is defined as 4.0% because excessive addition markedly reduces cold-rollability. The lower limit is defined as 2.0% from the viewpoint of solid solution strengthening and low core loss.

Al, like Si, increases specific resistance, but degrades castability when added in excess of 3.0%. Therefore, taking productivity into account, the upper limit of Al content is defined as 3.0%. Although a lower limit is not particularly defined, in the case of Al deoxidation, an Al content of 0.02% or greater is preferable from the viewpoint of stable deoxidization (prevention of nozzle clogging during casting). In the case of Si deoxidation, Al content is preferably less than 0.01%.

Nb is required for forming carbides and refining grain diameter. Sufficient carbide precipitation is not observed at an Nb content of less than 0.01%. The lower limit of Nb content is therefore defined as 0.01%. When Nb is added in excess of 0.05%, its effect saturates. The upper limit of Nb content is therefore set at 0.05%.

Ni effectively enables high strengthening of the steel sheet without causing much embrittlement. As it is an expensive element, however, the amount added is decided based on required strength. When incorporated, it is preferably added to a content of 0.5% or greater so it can thoroughly manifest its effect. The upper content limit is defined as 3.0% with consideration to cost.

Mn, like Si, increases specific resistance and is an effective element for solid solution strengthening. However, as explained later, in the case of the invention steel sheet, which utilizes carbides, the amount of Mn addition markedly affects steel sheet toughness. Mn content must therefore be limited.

The inventors newly discovered that the relationship between Mn and C is important for improving yield and productivity in motor core punching and steel sheet production and that in its relationship to C content, Mn content must be equal to or less than (0.6-10×C)

Although the reason for this is not altogether clear, the inventors reached the following conclusion.

When Mn content is high, MnS is coarse because it precipitates from a high temperature. When Mn content is low, MnS is fine because it precipitates at a low temperature. Since NbC frequently forms a composite precipitate with MnS, the state of NbC precipitation is strongly influenced by MnS. When Mn content is high, NbC is coarse and roughly dispersed, but when Mn content is low, it is fine and densely dispersed. Toughness improves as steel sheet grain diameter is finer. However, roughly dispersed carbides are probably weak in grain growth inhibiting ability, so that grain growth readily occurs to lower steel sheet toughness. It is also likely that the presence of coarse precipitates lowers toughness owing to concentration of stress around the precipitates during impact. In addition, carbide size and distribution is also affected by C content. When C content is high, carbides are coarse because they precipitate from a high temperature, and when C content is low, carbides are fine and densely distributed because they precipitate at a low temperature.

Based on the foregoing findings, the inventors learned that steel sheet toughness can be expressed in terms of the relationship between Mn content, which affects the nature of MnS precipitation, and the C content, which affects the precipitation of its own carbides, and that the relationship can be written as, in mass %, $Mn \leq 0.6-10 \times C$.

Therefore, based on the aforesaid lower limit of C content and the expression defining the Mn and C content relationship, the upper limit of Mn content is defined as 0.5%. From the viewpoint of steel sheet toughness, however, Mn content of 0.2% or less is more preferable. In view of the cost of Mn removal (demanganization), the lower limit of Mn is defined as 0.05%.

The reason for the numerical limits defined for the non-oriented electrical steel sheet will be explained.

The area fraction of the product sheet recrystallized portion is defined as 50% or greater from the viewpoint of obtaining stable material strength. Although high strength can be achieved by setting the finish annealing temperature low or the finish annealing time short to reduce the recrystallized portion area fraction to less than 50% and thus cause recovery structure from the cold-rolled structure to remain, this is not a suitable way to ensure prescribed strength because even slight variation of finish annealing temperature or time produces a large change in strength.

The yield strength of the product sheet in tensile testing is defined as 650 MPa or greater taking the fracture limit of the high rpm rotor into consideration. The yield strength is more preferably 700 MPa or greater. The yield stress defined here is the upper yield point value. The tensile test piece is taken in the rolling direction to have a shape as stipulated by JIS.

Breaking elongation is defined as 10% or greater because when it is less than 10%, cracks form in the vicinity of the steel sheet edges during punching and proceed to breakage owing to stress concentration. The recrystallization rate of the product sheet must be 50% or greater to achieve the breaking elongation of 10% or greater. This is because at a recrystallization rate of less than 50%, work strain remaining in the unrecrystallized portion greatly reduces breaking elongation.

The W10/400 core loss (core loss under excitation to 1.0 T at 400 Hz) is specified as 70 W/kg or less because when W10/400 core loss is greater than 70 W/kg, rotor heat generation is great, so that motor output falls owing to demagnetization of the magnets embedded in the rotor. W10/400 core loss is more preferably 50 W/kg or less High yield strength and breaking elongation can be attained by refining average grain diameter viewed in the steel sheet cross-section to 40 μm or less. The average grain diameter is therefore defined as 40 μm or less.

In the present invention, it is preferable for further improving productivity to use a hot-rolled sheet having a transition temperature in impact testing of 70° C. or less in the electrical steel sheet production process.

Considering the occurrence of cracking and/or breakage of the post-hot-rolled electrical steel sheet in the production process or motor core punching process to mean that the transition temperature of the hot-rolled sheet was high and that the post-hot-rolling production process itself was in the brittle zone, the inventors adjusted the production conditions to lower the transition temperature of the hot-rolled sheet to conduct post-hot-rolling production in the ductile zone and discovered that cracking and breakage no longer occurred.

And since a steel sheet steel temperature of 70° C. can be established in the pickling, cold rolling and finish annealing production processes, no problem of cracking or breakage occurs in the production processes after hot rolling so long as the transition temperature of the hot-rolled sheet is lower than this temperature. The upper limit of the transition temperature of the hot-rolled sheet is therefore defined as 70° C. A still lower transition temperature is of course preferable for strip running stability.

The transition temperature specified here is, as prescribed by JIS, the temperature interpolated as that at 50% ductile fracture in the transition curve representing the relationship between test temperature and ductile fracture rate. Alternatively, it can be interpolated as the temperature at the average value of the absorbed energies at ductile fracture rates of 0% and 100%.

Although the test piece was basically of the size prescribed by JIS, it was taken to have a width that was the thickness of the hot-rolled sheet. It therefore had a length in the rolling direction of 55 mm, a height of 10 mm and a width of around 1.5 to 3.0 mm depending on the thickness of the hot-rolled sheet. Moreover, it is preferable during testing to stack multiple test pieces to near the 10 mm thickness of a full-sized test piece.

The non-oriented electrical steel sheet of this invention can be produced by conventional processes of steelmaking, hot rolling (or hot rolling and hot-rolled sheet annealing), pickling, cold rolling and finish annealing, and no special conditions are required in the course of production. For example, it suffices to adopt such typical conditions as a slab heating temperature in hot rolling of 1,000 to 1,200° C., finish temperature of 800 to 1,000° C., and a coiling temperature of 700° C. or less. In the particular case where the transition temperature in the hot-rolled sheet impact test is 70° C. or less, it is important to inhibit recrystallization and C precipitation in the hot-rolled sheet, so the coiling temperature should be made 600° C. or less, preferably 550° C. or less.

Although a thinner hot-rolled sheet thickness is advantageous for preventing cracking and breakage during passage of the strip through pickling and cold rolling, the thickness should be appropriately adjusted taking the toughness, productivity and the like of the hot-rolled sheet into consideration. Further, whether or not hot-rolled sheet annealing should be conducted can be decided with consideration to hot-rolled sheet toughness, grain growth during finish annealing, physical properties, and electrical properties.

Since grain diameter affects the physical properties and core loss of the product sheet, the finish annealing conditions should be appropriately adjusted in accordance with the required properties. Particularly for achieving an average grain diameter of 40 μm or less and a recrystallized portion area fraction of 50% or greater, it is preferable to conduct finish annealing under conditions of an annealing temperature of 790 to 900° C. and an annealing time of 10 to 60 sec.

In the present invention, as explained in the foregoing, the electrical steel sheet is given a chemical composition of, in mass %, C: 0.01 to 0.05%, Si: 2.0 to 4.0%, Mn: 0.05 to 0.5%, Al: 3.0% or less and Nb: 0.01 to 0.05%, and optionally Ni at a preferable content of 0.5% to 3.0%, the balance being Fe and unavoidable impurities, Mn and C contents expressed in mass % are made to satisfy $Mn \leq 0.6-10 \times C$, recrystallized portion area fraction of the electrical steel sheet after finish annealing is made 50% or greater, yield strength in tensile testing is made 650 MPa or greater, breaking elongation is made 10% or greater, core loss W10/400 is made 70 W/kg or less, and average grain diameter viewed in steel sheet cross-section is preferably made 40 μm or less, and electrical steel sheet production is conducted using a hot-rolled sheet whose transition temperature in impact testing is 70° C. or less to provide at low cost a non-oriented electrical steel sheet excellent in strength that does not sacrifice yield or productivity during motor core or steel sheet production.

The possibilities and effects of implementing the present invention are explained below using examples.

It should be noted that the conditions used in the examples are for confirmational purposes only and the present invention is in no way limited thereto. Insofar as the purpose of the present invention is achieved, various conditions can be adopted in the working of the invention without departing from the gist thereof.

EXAMPLES

Example 1

Billets of the compositions shown in Table 1 were produced using a laboratory vacuum melting furnace. Each billet was heated at 1,100° C. for 60 min and immediately hot rolled to a thickness of 2.0 mm, whereafter the hot-rolled sheet was annealed at 900° C. for 1 min and cold rolled to a thickness of 0.35 mm in a single pass. The so-obtained cold-rolled sheet was finish annealed at 790° C. for 30 sec. As shown in Table 1, the specimens A2, A5, A7, A8 and A11 satisfying the conditions of the present invention exhibited excellent properties, namely, yield strength of 650 MPa or greater and breaking elongation of 10% or greater. In addition, the recrystallized portion area fraction of these specimens was 50% or greater. The specimens that did not satisfy the invention conditions, failed to meet the invention criteria. Specifically, specimens A1, A4 and A10 had yield strength of less than 650 MPa, specimen A6 had breaking elongation of less than 10%, and specimens A3 and A12 had core loss of greater than 70 W/kg.

TABLE 1

| Specimen | C (%) | Si (%) | Mn (%) | Al (%) | Nb (%) | 0.6-10 × C (%) | Yield strength (MPa) | Breaking elongation (%) | W10/400 (W/kg) | Remark |
|---|---|---|---|---|---|---|---|---|---|---|
| A1 | 0.008 | 2.93 | 0.33 | 0.49 | 0.027 | 0.52 | 623 | 19 | 41 | Comparative |
| A2 | 0.015 | | | | | 0.45 | 667 | 20 | 46 | Invention |
| A3 | 0.055 | | | | | 0.05 | 689 | 17 | 78 | Comparative |
| A4 | 0.032 | 1.55 | 0.23 | 1.42 | 0.041 | 0.28 | 513 | 31 | 65 | Comparative |
| A5 | | 2.21 | | | | | 678 | 23 | 53 | Invention |
| A6 | | 4.15 | | | | | 876 | 5 | 36 | Comparative |
| A7 | 0.041 | 3.13 | 0.05 | 0.024 | 0.015 | 0.19 | 667 | 25 | 56 | Invention |
| A8 | | | 0.18 | | | | 678 | 18 | 54 | Invention |
| A9 | | | 0.56 | | | | 685 | 8 | 57 | Comparative |
| A10 | 0.029 | 2.54 | 0.12 | 0.003 | 0.007 | 0.31 | 582 | 27 | 51 | Comparative |
| A11 | | | | | 0.021 | | 655 | 24 | 57 | Invention |
| A12 | | | | | 0.058 | | 676 | 21 | 79 | Comparative |

Example 2

Billets containing, in mass %, C: 0.032%, Si: 3.0%, Mn: 0.12 to 1.00%, Al: 0.3% and Nb: 0.035% were produced using a laboratory vacuum melting furnace. Each billet was heated at 1,100° C. for 60 min, immediately hot rolled to a thickness of 2.0 mm, pickled, and cold rolled to a thickness of 0.50 mm in a single pass. The so-obtained cold-rolled sheet was finish annealed at 800° C. for 30 sec. As shown in Table 2, all specimens exhibited excellent yield strength of 650 MPa or greater and core loss of 70 W/kg or less. Specimens B1 to B3, which satisfied the invention conditions, had breaking elongation of 10% or greater, good toughness of a hot-rolled sheet transition temperature of 70° C. or less, and recrystallized portion area fraction of 50% or greater. Among the specimens that did not satisfy the invention conditions, B4 had breaking elongation of less than 10%, while B5 to B8 not only had breaking elongation of less than 10% but also had hot-rolled sheet transition temperature of greater than 70° C.

TABLE 2

| Specimen | Mn (%) | 0.6-10 × C (%) | Yield strength (MPa) | Breaking elongation (%) | W10/400 (W/kg) | Hot-rolled sheet transition temperature (° C.) | Remark |
|---|---|---|---|---|---|---|---|
| B1 | 0.12 | 0.28 | 664 | 21 | 45 | 40 | Invention Examples |
| B2 | 0.18 | | 668 | 18 | 46 | 60 | |
| B3 | 0.25 | | 672 | 14 | 45 | 65 | |
| B4 | 0.31 | | 675 | 9 | 44 | 70 | Comparative Example (Breaking elongation outside range) |
| B5 | 0.48 | | 678 | 8 | 47 | 80 | Comparative Examples (Breaking elongation & Transition temperature outside ranges) |
| B6 | 0.75 | | 683 | 8 | 45 | 90 | |
| B7 | 0.88 | | 687 | 7 | 45 | 110 | |
| B8 | 1.00 | | 692 | 6 | 43 | 130 | |

Example 3

Billets containing, in mass %, C: 0.005 to 0.095%, Si: 2.7%, Mn: 0.24%, Al: 0.6% and Nb: 0.045% were produced using a laboratory vacuum melting furnace. Each billet was heated at 1,120° C. for 60 min, immediately hot rolled to a thickness of 1.8 mm, pickled, and cold rolled to a thickness of 0.35 mm in a single pass. The so-obtained cold-rolled sheet was finish annealed at 820° C. for 30 sec. As shown in Table 3, all specimens exhibited excellent yield strength of 650 MPa or greater. Specimens C1 to C4, which satisfied the invention conditions, had breaking elongation of 10% or greater and good toughness of a hot-rolled sheet transition temperature of 70° C. or less. Moreover, the recrystallized portion area fraction of these specimens was 50% or greater. Among the specimens that did not satisfy the invention conditions, C5 had breaking elongation of less than 10%, while C6 to C8 not only had breaking elongation of less than 10% but also had hot-rolled sheet transition temperature of greater than 70° C.

TABLE 3

| Specimen | C (%) | 0.6-10 × C (%) | Yield strength (MPa) | Breaking elongation (%) | W10/400 (W/kg) | Hot-rolled sheet transition temperature (° C.) | Remark |
|---|---|---|---|---|---|---|---|
| C1 | 0.005 | 0.55 | 653 | 21 | 45 | 10 | Invention Example |
| C2 | 0.012 | 0.48 | 653 | 18 | 46 | 10 | Invention Example |
| C3 | 0.022 | 0.38 | 661 | 16 | 45 | 30 | Invention Example |
| C4 | 0.035 | 0.25 | 662 | 14 | 44 | 50 | Invention Example |
| C5 | 0.044 | 0.16 | 663 | 8 | 47 | 65 | Comparative Example (Breaking elongation outside range) |
| C6 | 0.051 | 0.09 | 674 | 8 | 63 | 110 | Comparative Examples (Breaking elongation & Transition temperature outside ranges) |
| C7 | 0.062 | −0.02 | 679 | 7 | 73 | 120 | Comparative Examples (Breaking elongation, Core loss, & Transition temperature outside ranges) |
| C8 | 0.095 | −0.35 | 681 | 6 | 87 | 130 | |

Example 4

Billets containing, in mass %, C: 0.021%, Si: 3.5%, Mn: 0.18%, Al: 0.03%, Nb: 0.025% and Ni: 0.01 to 2.7% were produced using a laboratory vacuum melting furnace. Each billet was heated at 1,120° C. for 60 min, immediately hot rolled to a thickness of 1.8 mm, pickled, and cold rolled to a thickness of 0.35 mm in a single pass. The so-obtained cold-rolled sheet was finish annealed at 830° C. for 30 sec. As shown in Table 4, all specimens exhibited excellent yield strength of 650 MPa or greater, breaking elongation of 10% or greater, core loss of 70 W/kg or less, and hot-rolled sheet transition temperature of 70° C. or less. Recrystallized portion area fraction was 50% or greater. Specimens D4 to D10 having an Ni content of 0.5% or greater exhibited very high yield stress.

TABLE 4

| Specimen | C (%) | 0.6-10 × C (%) | Yield strength (MPa) | Breaking elongation (%) | W10/400 (W/kg) | Hot-rolled sheet transition temperature (° C.) | Remark |
|---|---|---|---|---|---|---|---|
| D1 | 0.01 | 0.39 | 664 | 26 | 45 | 65 | G |
| D2 | 0.12 | | 666 | 25 | 46 | 65 | G |
| D3 | 0.34 | | 669 | 24 | 45 | 65 | G |
| D4 | 0.56 | | 701 | 22 | 44 | 60 | E |
| D5 | 0.76 | | 721 | 21 | 47 | 55 | E |
| D6 | 0.97 | | 757 | 20 | 45 | 55 | E |
| D7 | 1.23 | | 789 | 19 | 43 | 55 | E |
| D8 | 1.78 | | 803 | 17 | 43 | 60 | E |
| D9 | 2.33 | | 856 | 16 | 45 | 60 | E |
| D10 | 2.70 | | 877 | 14 | 43 | 60 | E |

G: Satisfied invention conditions
E: Exceptionally high yield stress

Example 5

Billets containing, in mass %, C: 0.024%, Si: 2.8%, Mn: 0.17%, Al: 0.8% and Nb: 0.028% were produced using a laboratory vacuum melting furnace. Each billet was heated at 1,120° C. for 60 min, immediately hot rolled to a thickness of 1.8 mm, pickled, and cold rolled to a thickness of 0.35 mm in a single pass. Each so-obtained cold-rolled sheet was finish annealed at a different temperature between 700° C. and 900° C. for 30 sec. As shown in Table 5, all specimens other than E1, which had a low recrystallized portion area fraction, exhibited excellent properties, namely yield strength of 650 MPa or greater, breaking elongation of 10% or greater, and core loss of 70 W/kg or less. Specimens E2 to E4, whose average grain diameter was less that 40 μm and recrystallized portion area fraction was 50% or greater, were particularly noteworthy for very high yield stress and exceptionally good breaking elongation.

TABLE 5

| Specimen | Average grain diameter (μm) | Recrystallization area fraction (%) | Product sheet yield stress (MPa) | Breaking elongation (%) | W10/400 (W/kg) | Remark |
|---|---|---|---|---|---|---|
| E1 | Unmeasured | 20 | 753 | 5 | 70 | P |
| E2 | Unmeasured | 60 | 692 | 23 | 50 | E |
| E3 | 21 | 100 | 689 | 22 | 48 | E |
| E4 | 38 | 100 | 689 | 21 | 46 | E |
| E5 | 46 | 100 | 659 | 17 | 42 | G |
| E6 | 65 | 100 | 655 | 13 | 39 | G |

P: Invention conditions not satisfied (Recrystallization area fraction insufficient)
G: Satisfied invention conditions
E: Exceptionally high yield stress Industrial Applicability The present invention provides, as an iron core material for high rpm motors used in vehicles, electrical equipment and the like, an excellent non-oriented electrical steel sheet of optimal yield strength that does not sacrifice yield or productivity in motor core punching or steel sheet production. As such, it offers outstanding industrial utility.

What is claimed is:

1. A non-oriented electrical steel sheet consisting of, in mass %, C: 0.01 to 0.05%, Si: 2.0 to 4.0%, Mn: 0.05 to 0.5%, Al: 3.0% or less, Nb: 0.01 to 0.05%, and a balance of Fe and unavoidable impurities, wherein Mn and C contents expressed in mass % satisfy Mn≤0.6-10×C, recrystallized portion area fraction of the steel sheet is 50% or greater, yield strength in tensile testing is 650 MPa or greater, breaking elongation is 10% or greater, and core loss W10/400 is 70 W/kg or less.

2. A non-oriented electrical steel sheet consisting of, in mass %, C: 0.01 to 0.05%, Si: 2.0 to 4.0%, Mn: 0.05 to 0.5%, Al: 3.0% or less, Nb: 0.01 to 0.05%, Ni: more than 0.5% and less than 3.0%, and a balance of Fe and unavoidable impurities, wherein Mn and C contents expresses in mass % satisfy Mn≤0.6-10×C, recrystallized portion area fraction of the steel sheet of 50% or greater, yield strength in tensil testing is 650 MPa or greater, breaking elongation is 10% or greater, and core loss W10/400is 70 W/kg or less.

3. The non-oriented electrical steel sheet according to claim 2, wherein average grain diameter viewed in steel sheet cross-section is 40 μm or less.

4. The non-oriented electrical steel sheet according to claim 2, which is produced from a hot-rolled sheet whose transition temperature in impact testing is 70° C. or less by subsequent steps of annealing, pickling, cold rolling and finish-annealing the hot rolled sheet.

5. The non-oriented electrical steel sheet according to claim 2, which is produced from a hot-rolled sheet whose transition temperature in impact testing is 70° C. or less by subsequent steps, from which annealing is omitted, of pickling, cold rolling and finish annealing the hot-rolled sheet.

* * * * *